United States Patent [19]

Santy

[11] Patent Number: 4,531,661

[45] Date of Patent: Jul. 30, 1985

[54] SKI AND POLE HOLDER

[76] Inventor: James L. Santy, Box 783, Park City, Utah 84060

[21] Appl. No.: 590,564

[22] Filed: Mar. 16, 1984

[51] Int. Cl.[3] ..... B65D 63/00

[52] U.S. Cl. ..... 224/191; 224/917; 294/147; 280/814

[58] Field of Search ..... 224/917, 907, 191; 280/814; 294/147

[56] References Cited

U.S. PATENT DOCUMENTS

| | | | |
|---|---|---|---|
| 3,731,348 | 5/1973 | Luehne | 224/901 X |
| 3,841,542 | 10/1974 | Hogensen, Jr. | 224/917 X |
| 3,947,927 | 4/1976 | Rosenthal | 294/147 X |
| 3,994,048 | 11/1976 | Rosenthal | 294/147 X |
| 4,120,437 | 10/1978 | Hara | 280/814 |

FOREIGN PATENT DOCUMENTS

| | | | |
|---|---|---|---|
| 570654 | 2/1933 | Fed. Rep. of Germany | 294/147 |

*Primary Examiner*—Stephen Marcus
*Assistant Examiner*—Robert Petrik
*Attorney, Agent, or Firm*—B. Deon Criddle

[57] ABSTRACT

A ski and pole holder comprising a pair of straps sewn together in back to back fashion at one of their ends and having connector rings at the ends and with opposite ends of the straps being passed through the rings after being respectively wrapped around a pair of skis and a pair of ski poles and the running ends then being doubled back to fasten to themselves.

1 Claim, 4 Drawing Figures

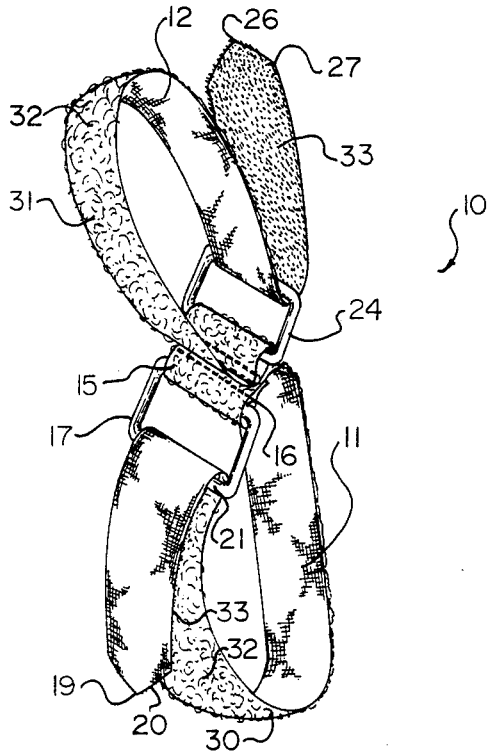
FIG. 1
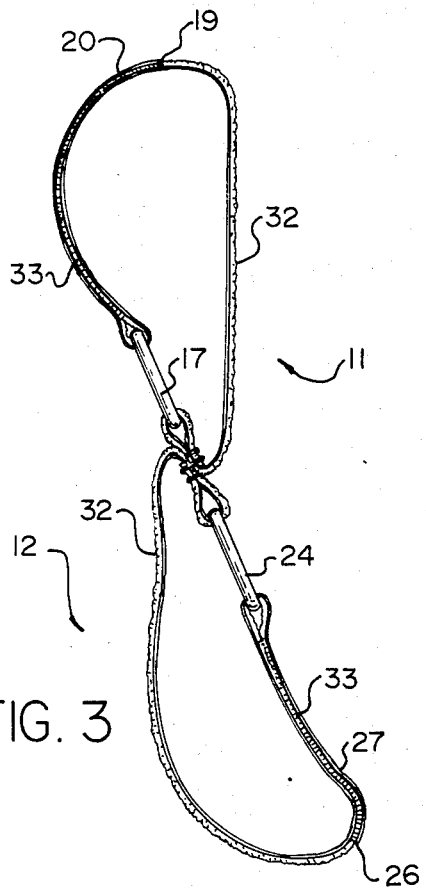
FIG. 3
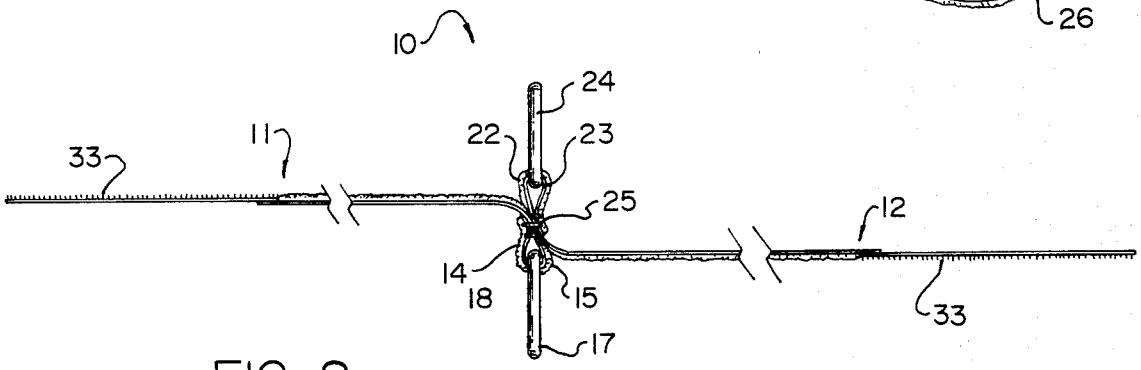
FIG. 2
FIG. 4
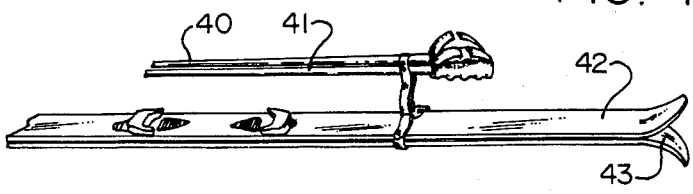

SKI AND POLE HOLDER

BRIEF DESCRIPTION

1. Field of the Invention

This invention relates to holders for skis and ski poles and is particularly concerned with holders formed from straps that encircle skis and poles to hold them in an assembled compact condition, 2. Prior Art The need for holders for skis and ski poles that will hold them in an assembled and compacted condition for storage, transportation and the like has long been recognized, U.S. Pat. Nos. 2,530,695 3,841,542 and 3,920,166 for example disclose ski holders having straps adapted to fit over the shoulder of a user and to encircle skis or skis and ski-poles, and U.S. Pat. No. 2,530,695, teaches the use of a ski and ski-pole holder than can be used or stored by a user as a belt or waistband.

Other patents disclose various types of clamping devices to clamp skis and ski-poles together so that they can be conveniently stored or carried.

While the prior art references shown various structures for holding skis and ski-poles to be compactly stored transported or handled I am not aware of a holder than can be easily adapted for different configurations and than can be conveniently carried during use of the skis and ski-poles.

OBJECTS OF THE INVENTION

Principal objects of the invention are to provide a ski and ski-pole holder than can be used to make an assembled package wherein secured ski-poles become a carrying handle for secured skis, that will effectively hold the skis and ski-poles during storage and that will be reduced to be easily carried in a pocket during use of the skis and ski poles.

FEATURES OF THE INVENTION

Principal features of the invention include a pair of straps respectively adapted to encircle a pair of skis arranged in base to base contact and a pair of ski-poles arranged in parallel relationship and a pair of rings interconnected by first ends of the straps and providing retainers for the other ends of the straps. Infinitely adjustable connector means on the other ends of the straps permit the straps to be used with skis and ski-poles of differing configurations and thicknesses.

Additional objects and features of the invention will become apparent to those skilled in the art from the following detailed description and claims.

THE DRAWINGS

In the drawings:

FIG. 1, is a perspective view of the holder of the invention, with the ends of the straps thereof released;

FIG. 2, a side elevation view, with the straps extended;

FIG. 3, a simialr view with the straps ends secured; and

FIG. 4, a view of a holder securing skis and ski-poles, with the skis and ski-poles shown fragementarily;

DETAILED DESCRIPTION

Referring now to the drawing:

In the illustrated preferred embodiment, the holder of the invention is shown generally at 10.

The holder 10 comprises a shorter strap 11 and a longer strap 12. One tip 14 on end 15 of strap 11 passes around one side 16 of a ring 17 to be sewn at 18 to the end 15 and the other tip 19 of the opposite end 20 is adapted to be inserted through the ring 15 and around an opposite side 21 of ring 15.

A tip 22 of end 23 of longer strap 12 passes around one side of a second ring 24 and is sewn at 25 to the end 23. The other tip 26 of the other end 27 is adapted to be inserted through the ring 24 and to be passed around the opposite side thereof.

An outer surface 30 of the strap 11 and an outer surface 31 of the strap 11 are of napped material 32 for a portion of their lengths and then have hooked surfaces 33 continuing from the napped surface to the tips 19 and 26. Thus, when the tips 19 and 26 are inserted through the rings 15 and 24 and are folded back on themselves, the hooked surfaces 32 will engage the napped surfaces 33 to hold the tips 19 and 26 to the surfaces 30 and 31, respectively.

In use, the tips 19 and 26 are pulled free from the surfaces 30 and 31 and from the rings 19 and 26. The shorter straps 11 of a pair of spaced apart holders 10 are each wrapped tightly around the parallel shafts of a pair of ski-poles (such as are shown fragmentarily at 40 and 41) and the tips 19 are inserted through rings 15 and are locked to surfaces 30, as previously discribed.

The longer straps 12 of the pair of spaced apart holders 10 are wrapped tightly around a pair of skis (such as are shown generally at 42 and 43 and arranged in bottom to bottom engagement) and the tips 26 thereof are passed through rings 24 and are locked to surfaces 31, as previously described.

The spaced apart holders 10 thus securely hold the ski-poles and the skis and with the ski-poles forming a carrying handle for the assembly of ski-poles and poles.

Although a preferred form of my invention has been herein disclosed, it is to be understood that the present disclosure is by way of example and that variations are possible without departing from the subject matter coming within the scope of the following claims, which subject matter I regard as my invention.

I claim:

1. A ski and ski pole holder comprising a pair of straps, each having a back surface and a front surface and with said straps being connected in back to back relationship adjacent one of their ends and each of said ends being passed through and around a ring and sewn to the strap at the back-to-back connections of said straps;

a napped face on each of the front surfaces of said straps extending from the back-to-back connections for a length of the strap; and a hooked surface on each of the straps, said hooked surfaces extending from the napped surfaces to the other ends of the straps, whereby upon insertion of said other ends through the rings and turning of said other ends back upon themselves the hooked surfaces will interlock with the napped surfaces.

* * * * *